US009756905B2

(12) United States Patent
Bielecki

(10) Patent No.: US 9,756,905 B2
(45) Date of Patent: Sep. 12, 2017

(54) MAGNETIC HOLDING ASSEMBLY

(71) Applicant: Pavel Bielecki, Monterey, CA (US)

(72) Inventor: Pavel Bielecki, Monterey, CA (US)

( * ) Notice: Subject to any disclaimer, the term of this patent is extended or adjusted under 35 U.S.C. 154(b) by 0 days.

(21) Appl. No.: 14/166,233

(22) Filed: Jan. 28, 2014

(65) Prior Publication Data

US 2015/0208766 A1 Jul. 30, 2015

(51) Int. Cl.

| | |
|---|---|
| ***A47G 1/17*** | (2006.01) |
| ***A44B 17/00*** | (2006.01) |
| ***A41F 1/00*** | (2006.01) |
| *A44B 1/02* | (2006.01) |
| *A47K 3/38* | (2006.01) |

(52) U.S. Cl.

CPC ..... *A44B 17/0041* (2013.01); *A41F 1/002* (2013.01); *A44B 1/02* (2013.01); *A47K 3/38* (2013.01); *Y10T 24/32* (2015.01)

(58) Field of Classification Search

CPC ..... A47F 1/002; A44B 17/0041; A44B 1/02; Y10T 24/32; A47K 3/38; A41F 1/002; A47G 1/17; B60R 2011/0057; B60R 2011/007; F16B 2001/0035

USPC ..... 248/206.5, 683, 309.4, 303, 301, 304, 248/322, 339; 40/661.01; 211/181.1

See application file for complete search history.

(56) References Cited

U.S. PATENT DOCUMENTS 4,236,331 A * 12/1980 Mattson ..... A44C 3/001 40/1.5
4,642,257 A 2/1987 Chase
4,754,532 A 7/1988 Thomson et al.
5,711,100 A * 1/1998 Elmer ..... G09F 21/04 248/206.5
5,746,329 A * 5/1998 Rondeau ..... A47G 1/17 211/123
6,035,449 A 3/2000 Galler et al.
6,295,702 B1 10/2001 Bauer
6,684,544 B1 * 2/2004 Buettell ..... G09F 7/04 40/1.5
6,848,207 B1 * 2/2005 Powell ..... G09F 3/207 224/257
7,748,544 B1 * 7/2010 Davitz ..... A47B 96/06 211/70.6
8,479,685 B2 * 7/2013 Sprung ..... A01K 63/006 119/51.04

(Continued)

OTHER PUBLICATIONS

Fundamental Relationships.*
Force between magnets; Wikepedia.*

*Primary Examiner* — Christopher E Garft

(57) ABSTRACT

A holding assembly comprises a first button shaped portion having a first contact portion comprising a ferromagnetic plate. A magnetic core is embedded in the first contact portion. A magnetic shield is disposed on the first contact portion to direct magnetic flux from the magnetic core towards the first contact portion. A second button shaped portion has a second contact portion comprising a ferromagnetic plate. A magnetic shield is disposed on the second contact portion to direct magnetic flux from the magnetic core towards the second contact portion. The second button shaped portion is positionable on a non-magnetic sheet with the second contact portion opposing the first contact portion to clamp to the non-magnetic sheet where the magnetic flux is substantially contained within the holding assembly.

12 Claims, 9 Drawing Sheets

(56) References Cited

U.S. PATENT DOCUMENTS

| | | | | |
|---|---|---|---|---|
| 2006/0151409 | A1* | 7/2006 | Schmoelzer | A47G 25/06<br>211/85.9 |
| 2009/0014105 | A1 | 1/2009 | Shattuck | |
| 2009/0027149 | A1* | 1/2009 | Kocijan | B25B 11/002<br>335/288 |
| 2009/0211533 | A1* | 8/2009 | Sprung | A47L 1/15<br>119/264 |
| 2009/0212186 | A1* | 8/2009 | Wang | A47G 25/0607<br>248/304 |

* cited by examiner

MAGNETIC HOLDING ASSEMBLY

CROSS-REFERENCE TO RELATED APPLICATIONS

Not applicable.

RELATED CO-PENDING U.S. PATENT APPLICATIONS

Not applicable.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

One or more embodiments of the invention generally relate to magnetic devices. More particularly, the invention relates to magnetic devices with means for minimizing magnetic flux in certain directions.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Holding power of magnetic assemblies may be proportional to strength of magnet or magnets embedded in the magnetic assemblies. Stronger magnets may result in stronger holding power, which may allow a magnetic assembly to hold heavier objects. However, magnetic fields that surround such holding assemblies may also attract and/or affect other, unintended magnetic objects in its vicinity including, without limitation, pacemakers, implants, magnetic storage media, jewelry, watches, keys, scissors, etc. This may result in malfunction of such objects or undesired change in their location or movement, which can lead to damage or injury. Exposure to magnetic fields may also have undesirable biological effects.

Also, securing a position of magnetic assemblies at desired locations may largely rely on frictional resistance between material clamped by a holding assembly and surfaces of the holding assembly itself. Magnetic force which may hold parts of an assembly together may provide little resistance against shifting/sliding of parts of the assembly.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. One such aspect of the prior art shows a variable strength magnetic holding assembly. By way of educational background, another aspect of the prior art generally useful to be aware of teaches of a locking magnetic fastener including manually separable male and female assemblies, the female assembly having an interior chamber accessible through an aperture and containing a magnet, and the male assembly having a projecting member containing ferromagnetic material that is inserted through the aperture into the chamber to be held by the magnet. Yet another such aspect of the prior art discloses of a non-rigid identification card holder which can be securely attached via magnetic fasteners within flaps of the holder. However, these solutions may not provide an effective means for providing strong magnetic force and/or minimization of magnetic flux. A solution which did so would be desirable.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which.

Figure 1:
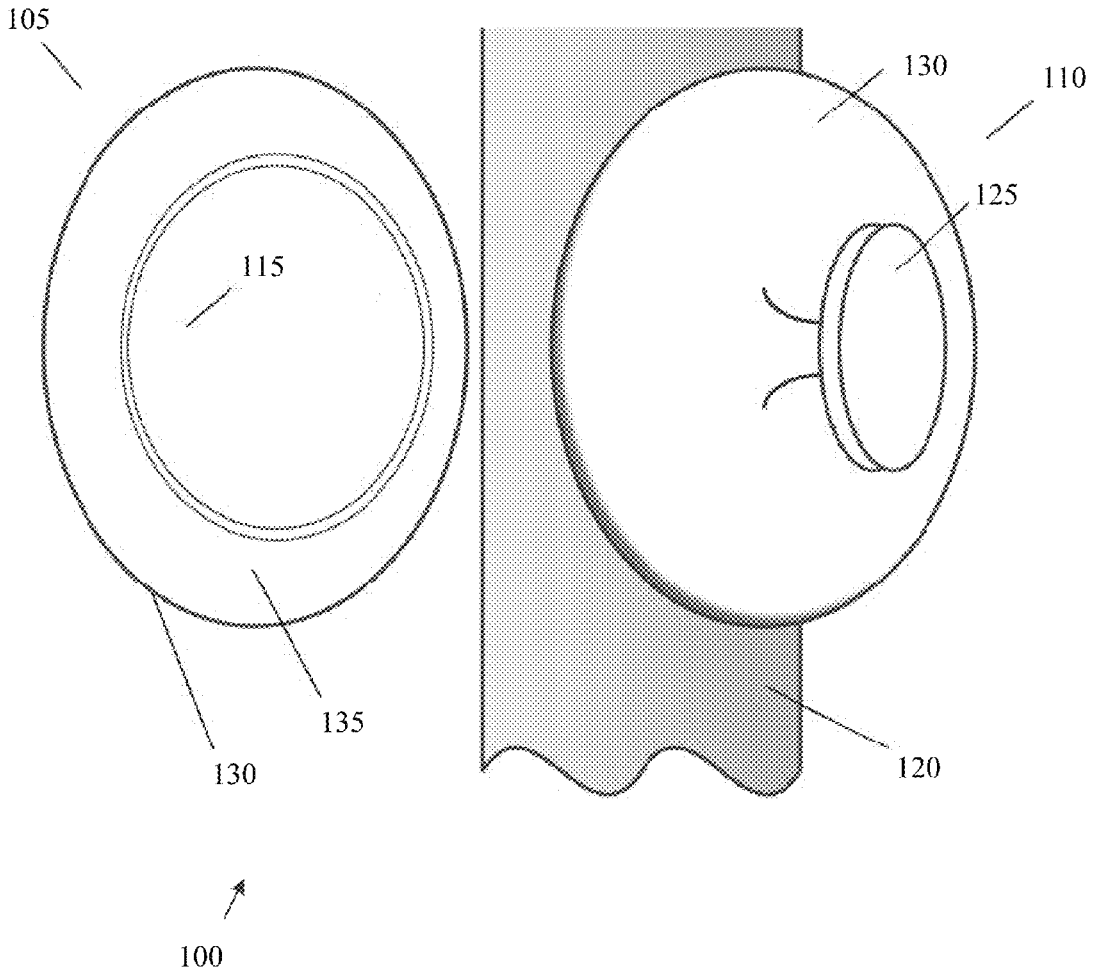
FIG. 1 is an illustration of an exemplary device which may have magnetic components, in accordance with an embodiment of the present invention.

Unless otherwise indicated illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

Headings provided herein are for convenience and are not to be taken as limiting the disclosure in any way.

The enumerated listing of items does not imply that any or all of the items are mutually exclusive, unless expressly specified otherwise.

The terms "a", "an" and "the" mean "one or more", unless expressly specified otherwise.

Devices or system modules that are in at least general communication with each other need not be in continuous communication with each other, unless expressly specified otherwise. In addition, devices or system modules that are in at least general communication with each other may communicate directly or indirectly through one or more intermediaries.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may be configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

In the following description and claims, the terms "coupled" and "connected," along with their derivatives, may be used. It should be understood that these terms are not intended as synonyms for each other. Rather, in particular embodiments, "connected" may be used to indicate that two or more elements are in direct physical, magnetic or electrical contact with each other. "Coupled" may mean that two or more elements are in direct physical, magnetic or electrical contact. However, "coupled" may also mean that two or more elements are not in direct contact with each other, but yet still cooperate or interact with each other.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

Some embodiments of the present invention may provide means and/or methods for manufacturing devices which may have magnetic components. Some of these embodiments may be suitable for dispersing magnetic flux. Other embodiments may also incorporate one or outer layers which may, without limitation, enhance frictional force, protect against corrosion, contain magnet fragments, and protect against harm to external objects and/or people.

FIG. 1 is an illustration of an exemplary device which may have magnetic components, in accordance with an embodiment of the present invention. In some embodiments, a device may comprise multiple button like parts. In the present embodiment, a device may have a first part 105 and a second part 110. In some embodiments, one or more of the multiple parts may exert magnetic force on one or more other of the multiple parts. In the present embodiment, one or more part may utilize a magnetic core 115 to generate and/or receive a magnetic force on one or more other parts through a partition 120. In some embodiments, partition 120 may be composed of any suitable non-ferromagnetic material, including, without limitation, plastic, fabric, glass, cardboard, plywood, particle board, or other non-ferromagnetic material. In some of these embodiments, partition 120 may be flexible or rigid. In the present embodiment, the second part 110 may have an extending piece 125. In one or more alternative embodiments, multiple parts may have extending pieces 125. In some embodiments, extending piece 125 may provide aesthetic appeal and/or means for, without limitation, hanging objects. In the present embodiment, one or more piece may have an outer shell 130 portion. In some alternative embodiments, a device may have three or more parts which may be suitable for exerting magnetic force on each other through a multi-sided partition, such as, without limitation, a triangular pillar.

In some embodiments, parts of device may contain magnets having opposing magnetic components from each other. In a non-limiting example, a contact portion (side which may make contact with partition 120) of a first part 105 may constitute a North magnetic pole while a contact portion (side which may make contact with partition 120) of a second part 110 may constitute a South magnetic pole. In some embodiments, non-contact portion (side opposite of contact portion) may be embedded within a shell which may be composed of, without limitation, ferromagnetic material.

Figure 2A:
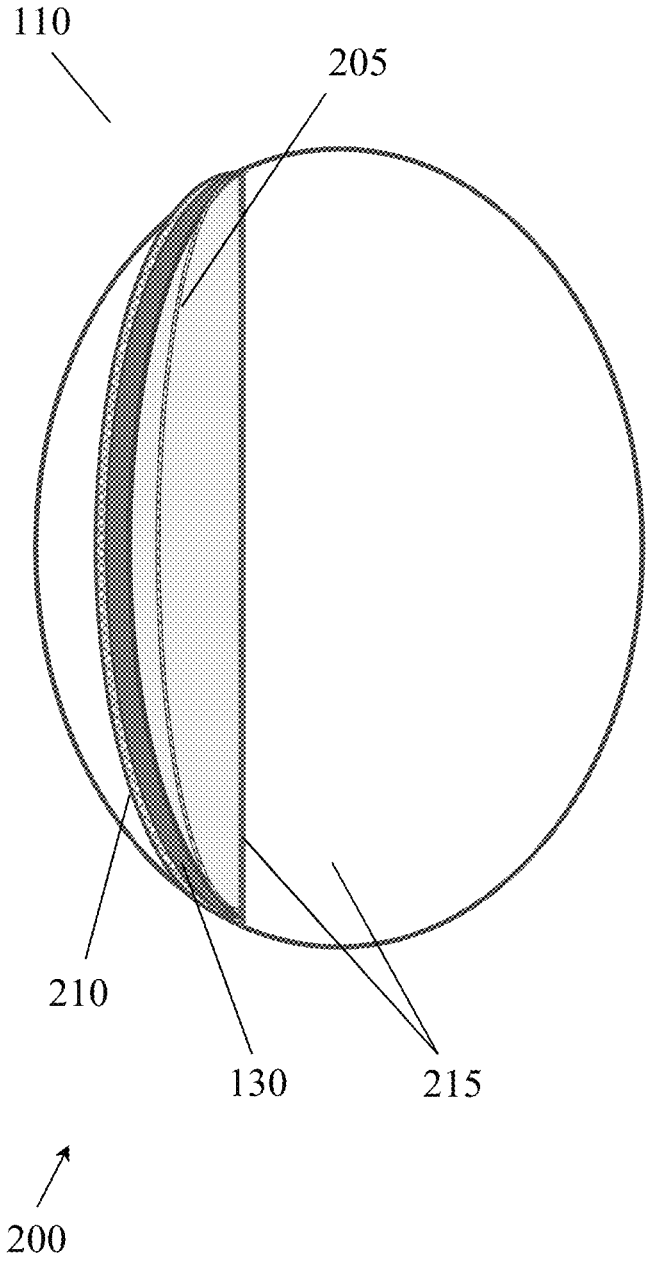
FIG. 2A is an internal layered illustration of an exemplary portion of an embodiment device having means for minimizing magnetic flux, in accordance with an embodiment of the present invention.

FIG. 2A is an internal layered illustration of an exemplary portion of an embodiment device having means for minimizing magnetic flux, in accordance with an embodiment of the present invention. In the present embodiment, device may have one or more magnetic shields 205 for minimizing a magnetic field in outer shell 130 and maximizing the magnetic field in the contact portion. In some embodiments, a device may have multiple layers of magnetic shields 205. In the present embodiment, device may have a decorative layer 210 (or shield). In some embodiments, decorative layer 210 may be replaced by further magnetic shield 205 layers. In the present embodiment, device may have a contact plate 215. In some embodiments, contact plate may be suitable for contacting external objects, such as partitions 120.

Figure 2B:
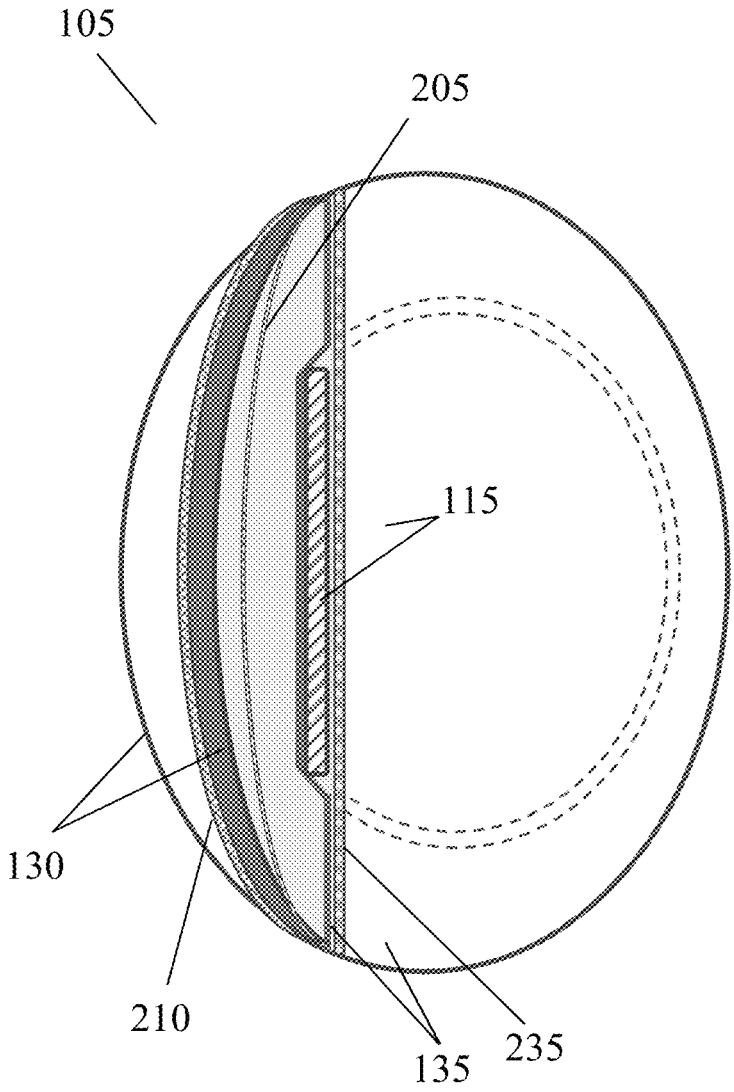
FIG. 2B is an internal layered illustration of an exemplary portion of an embodiment device having means for minimizing magnetic flux, in accordance with an embodiment of the present invention.

FIG. 2B is an internal layered illustration of an exemplary portion of an embodiment device having means for minimizing magnetic flux, in accordance with an embodiment of the present invention. In the present embodiment, device may have one or more magnetic shields 205 for minimizing a magnetic field in outer shell 130 and maximizing the magnetic field in the contact portion. In the present embodiment, core magnet 115 may be embedded in contact plate 135. In some embodiments, contact plate may have a recess or indenture where core magnet may be embedded. In many embodiments, core magnet 115 and contact plate 135 comprise a flat contact portion. In some embodiments, a device may have multiple layers of magnetic shields 205. In the present embodiment, device may have a decorative layer 210 (or shield). In some embodiments, decorative layer 210 may be replaced by further magnetic shield 205 layers. In many embodiments, core magnet 115 and contact plate 135 are covered and sealed by a with a protective layer 235 that may keep the core magnet 115 securely in desired precise location, keep potential magnet fragments safely contained, provide protection against corrosion for both the contact plate 135 and the core magnet 115, and enhance the friction on the contact portion of the assembly. Examples of the protective layer include, but are not limited to, self-adhering plastic tape (transparent or color), liquid vinyl applied as paint or spray, liquid silicone rubber spray, and similar products that have a higher frictional component than the contact portion. In some embodiments, protective layer 235 may provide a soft cushion if a body part (finger) gets caught between the first part 105 and the second part 110. A non-limiting example of a material for the protective layer may be a thin silicon mat such as used to keep smart phones on the car dash board.

Figure 2C:
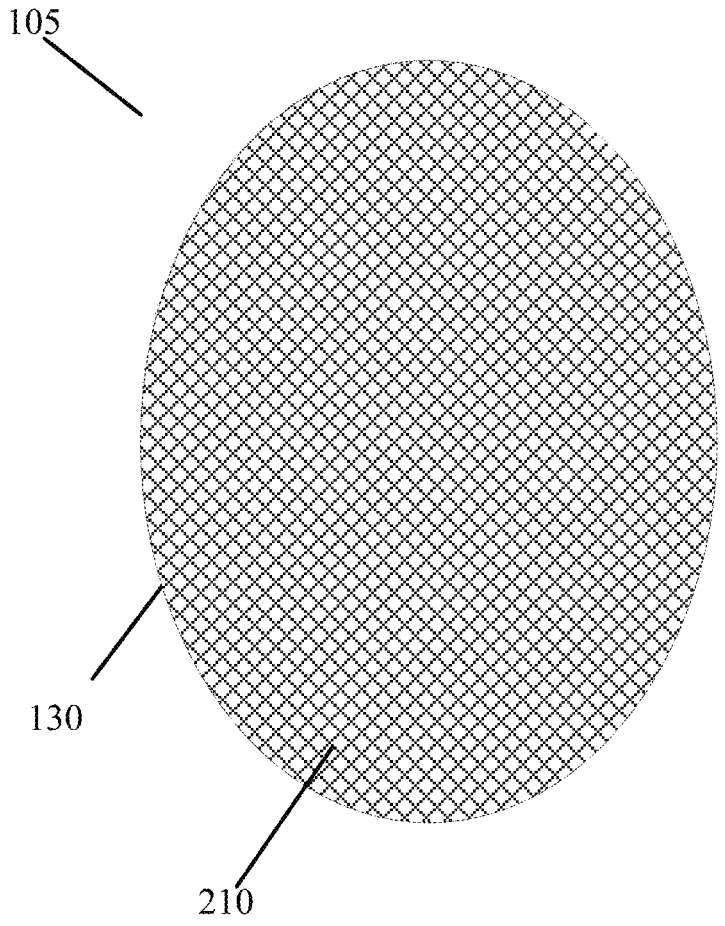
FIG. 2C is an illustration of an exemplary portion of an embodiment device, in accordance with an embodiment of the present invention.

FIG. 2C is an illustration of an exemplary portion of an embodiment device, in accordance with an embodiment of the present invention. In the present embodiment, the non-contact side of outer shell 130 is shown. In many embodiment, outer shell 130 may comprise a transparent or semi-transparent material where decorative layer 210 is visible.

Figure 2D:
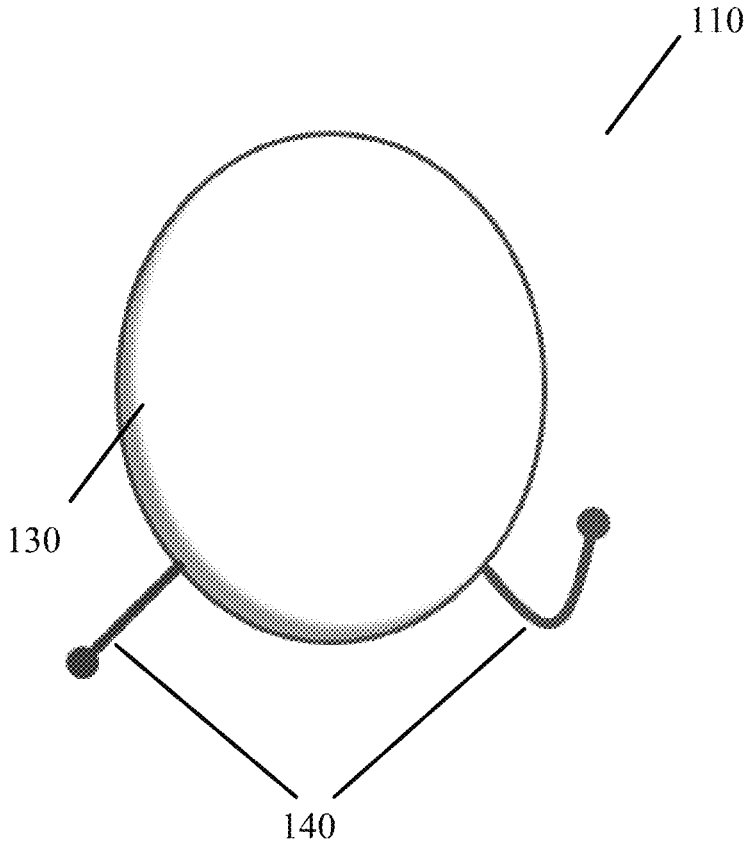
FIG. 2D is an illustration of an exemplary portion of an embodiment device, in accordance with an embodiment of the present invention.

FIG. 2D is an illustration of an exemplary portion of an embodiment device, in accordance with an embodiment of the present invention. In the present embodiment, bendable plastic-wrapped wires 140 may protrude from the outer shell 130 around its perimeter and may be terminated by a protective safety cap. A user may bend the wire into a desired shape for holding items and then straighten it back. The rigidity of the wire may allow for sufficiently easy shaping, but allowing to "unbend" if a child's finger or body part gets accidently entrapped in the hook, but still provide sufficient useful carrying capacity.

Figure 3:
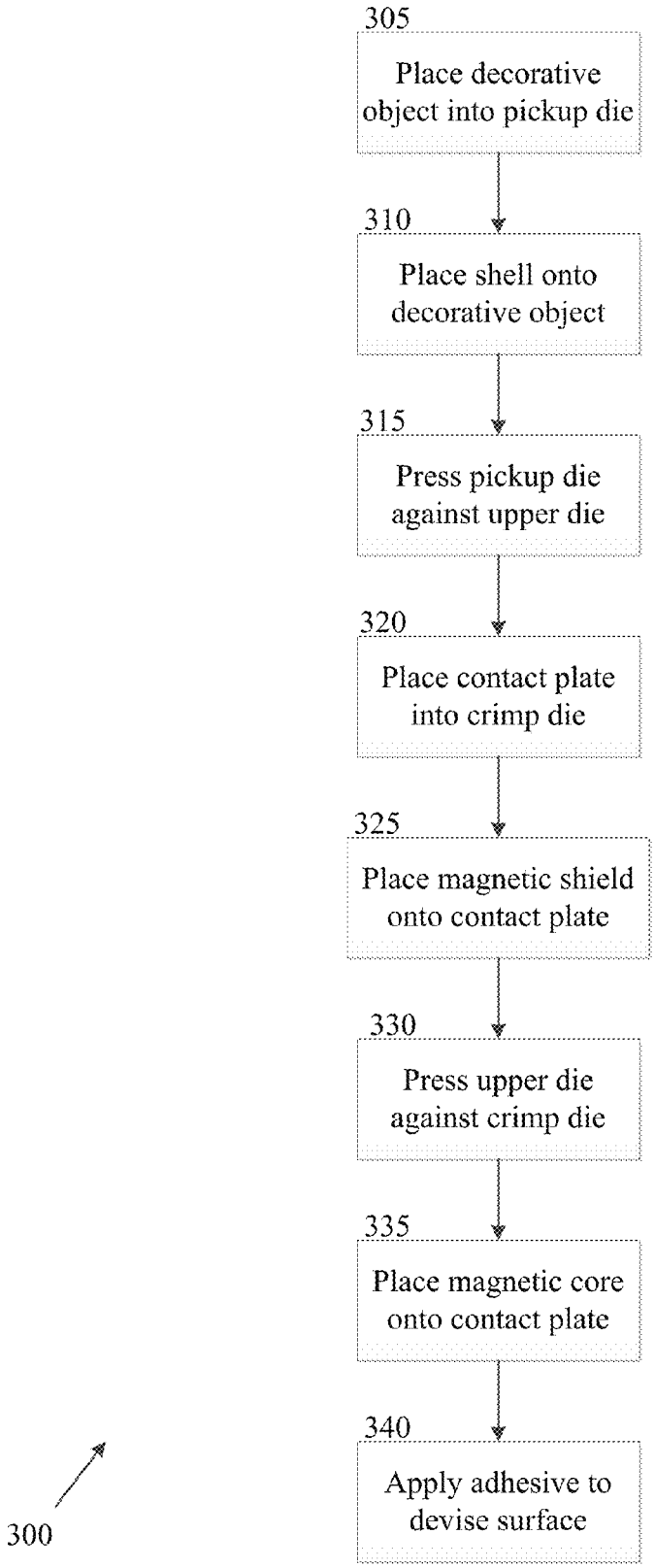
FIG. 3 is an illustration of an exemplary method for manufacturing a device having magnetic components, in accordance with an embodiment of the present invention.

FIG. 3 is an illustration of an exemplary method for manufacturing a device having magnetic components, in accordance with an embodiment of the present invention. In the present embodiment, one may place a decorative layer 210 into a pickup die of a machine in a step 305. In some embodiments, a decorative layer 210 may be any suitable size and/or shape. In a non-limiting example, a decorative layer 210 may be a circular and/or flat piece of plastic which may have an image embossed on one or more surfaces. In some embodiments, a pickup die may be any suitable receiving portion of a machine, and may be sized to fit a corresponding decorative layer 210. In the present embodiment, one may place a shell 130 onto decorative object in a step 310. In some embodiments, shell 130 may fit into pickup die. In the present embodiment, one may press pickup die against an upper die of machine in a step 315. In some embodiments, pickup die and upper die may be shaped to fit together. In many embodiments, upper die may receive and contain decorative layer 210 and/or shell 130 after pressing has occurred. In the present embodiment, one may place a contact plate 215 into a crimp die in a step 320. Further, in the present embodiment, one may place a magnetic shield 205 on top of contact plate 215 in a step 325. In some embodiments, magnetic shield 205 may fit into crimp die. In the present embodiment, one may press upper die, which may contain decorative layer 210 and/or shell 130, against crimp die in a step 330. In some embodiments, multiple pieces, including, without limitation, decorative layer 210, shell 130, contact plate 215, and magnetic shield 205, may crimp together to form a single device after pressing has occurred. In the present embodiment, one may place a magnetic core 115 onto an exposed portion of contact plate 215 in a step 335. In alternative embodiments, one may place magnetic core 115 onto any surface of device. In the present embodiment, one may apply an adhesive onto a portion of contact plate 215, magnetic core 115, or other surface of device in a step 340. In a non-limiting example, one may spray and/or paint a layer of liquid plastic tape onto surface of device. In the present non-limiting example, adhesive may be any substance and/or material suitable for enhancing frictional force at one or more contact areas. In some embodiments, adhesive may act as a spacer between magnetic core 115 and contact plate 215. In some of these embodiments, spacer may provide for containment of fragments of magnetic core 115, if any, and may enhance friction between contact plate 215 and surface of a material to which device may be attached.

Figure 4:
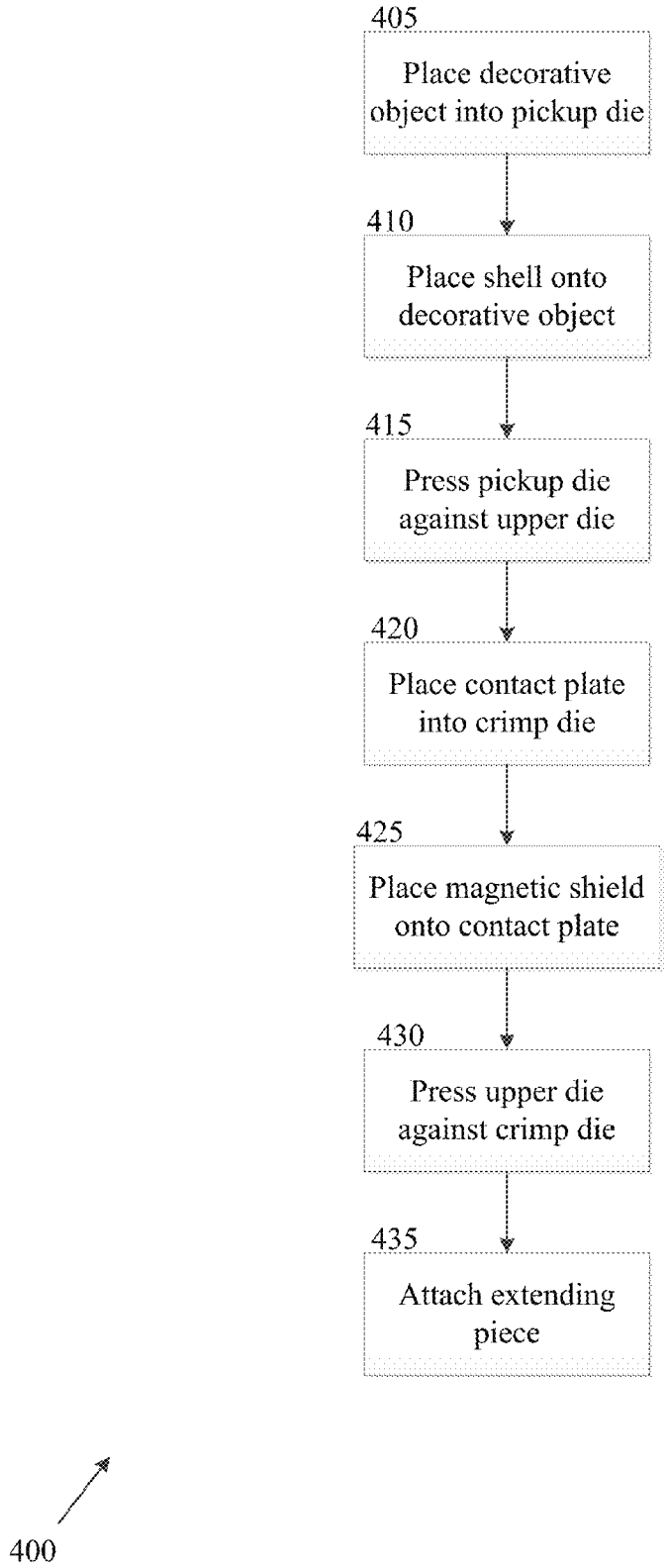
FIG. 4 is an illustration of an exemplary method for manufacturing a device having an extending piece 125.

FIG. 4 is an illustration of an exemplary method for manufacturing a device having an extending piece 125. In the present embodiment, one may place a decorative layer 210 into a pickup die of a machine in a step 405. In some embodiments, a decorative layer 210 may be any suitable size and/or shape. In a non-limiting example, a decorative layer 210 may be a circular and/or flat piece of plastic which may have an image embossed on one or more surfaces. In some embodiments, a pickup die may be any suitable receiving portion of a machine, and may be sized to fit a corresponding decorative layer 210. In the present embodiment, one may place a shell 130 onto decorative object in a step 410. In some embodiments, shell 130 may fit into pickup die. In the present embodiment, one may press pickup die against an upper die of machine in a step 415. In some embodiments, pickup die and upper die may be shaped to fit together. In many embodiments, upper die may receive and contain decorative layer 210 and/or shell 130 after pressing has occurred. In the present embodiment, one may place a contact plate 215 into a crimp die in a step 420. Further, in the present embodiment, one may place a magnetic shield 205 on top of contact plate 215 in a step 425. In some embodiments, magnetic shield 205 may fit into crimp die. In the present embodiment, one may press upper die, which may contain decorative layer 210 and/or shell 130, against crimp die in a step 430. In some embodiments, multiple pieces, including, without limitation, decorative layer 210, shell 130, contact plate 215, and magnetic shield 205, may crimp together to form a single device after pressing has occurred. In the present embodiment, one may attach extending piece 125 to shell 130 in a step 435. In some embodiments, one may attach extending piece 125 by any suitable means, including, without limitation, preferably corrosion resistant screws or glue.

Some embodiments may be suitable for use in any environment. Other embodiments may perform well in environments in which magnet core may maintain magnetic property. In a non-limiting example, a magnet core utilizing neodymium magnets of certain grade may be more or less effective depending on environment temperature. In many embodiments, any type of magnet may be suitable.

In some embodiments, one or more parts may attach and/or embed into one or more decorative objects. In a non-limiting example, a nautical decor shell or tourist souvenir décor item or similar item may be positioned and/or displayed on a sheet of material such as, without limitation, curtain, drape, table cloth, glass panel, door screen, etc. In some embodiments, shell 130 may be flat or otherwise adjusted to suitably affix to a decorative object or other item.

In many embodiments, magnetic core 115 may be any suitable size and/or shape. In a non-limiting example, magnetic core 115 may be round and thin so as to fit into and/or be encompassed by a recessed portion of contact plate 215 to form a "mounting magnet". In another non-limiting example, magnetic core 115 may have a shape of a magnet disk with a center hole. In the present non-limiting example, center hole may be suitable to receive a screw (countersunk magnet) and/or a magnet ring. In another non-limiting example, magnetic core 115 may be comprised of multiple magnets which may be placed around a perimeter portion of contact plate or other surface. In the present non-limiting example, positioning the multiple magnets around a perimeter may provide resistance to forces which may act attempt to separate pieces of device.

In some embodiments, device may substantially minimize magnetic flux in various directions. In a non-limiting example, a device may utilize a mounting magnet which may channel magnetic flux from a non-contact surface to a contact area via ferromagnetic contact plate 215. In the present non-limiting example, channeling magnetic flux may enhance total usable magnetic force of a magnet and/or may substantially minimize magnetic field in undesirable locations. In another non-limiting example, a device may utilize a magnetic core 115 in a form of a Halbach array, which may substantially maximize magnetic force in desired directions (e.g. along contact area) and/or may minimize magnetic field in undesirable directions.

In one or more embodiments, magnetic core 115 may attach to contact plate 215. In some of these embodiments, any suitable method and/or means of attachment may be used. In a non-limiting example, one may use glue to attach magnetic core 115 to contact plate 215. In another non-limiting example, one may use a magnet which may have a vinyl coating. In the present non-limiting example, the magnet may attach to a mounting plate by any means, including, without limitation, one or more screws. In some embodiments, a contact area of a magnetic core and/or a magnet may have a covering to maintain position. Some embodiments may utilize a soft cushion composed of any suitable material, such as, without limitation, tape, vinyl, liquid silicone rubber spray, micro-suction or nano-suction tape or pad, etc. to provide protection for users and parts of device and to enhance the adherence of the device to partition 120.

In at least one embodiment, various materials may be suitable for use as a magnetic shield 205. In some of these embodiments, suitable materials for strong magnetic fields (e.g. over 1 Gauss) may include, without limitation, Giron, MagnetShield, and PaperShield. In one or more embodiments, suitable materials for weak or moderate fields (e.g. milliGauss levels) may include, without limitation, magnetic shielding foil, Mag-Stop plates, and JointShield. In many embodiments, a contact plate 215 may be appropriately sized and/or profiled to act in conjunction with a magnetic core 115 as a mounting magnet. In some of these embodiments, the contact plate 215 may be composed of any material, including, without limitation, materials with ferromagnetic properties. In many embodiments, contact plate 215 and/or any outer surfaces may be composed of high saturation magnetic alloy of suitable thickness to maintain shape when in use and/or under load.

In some embodiments, an internal magnetic shield 205 (which may be situated between contact plate 215 and shell dome 130) may be composed of high saturation magnetic alloy having shielding properties and thickness proportional to desired degree of magnetic field attenuation. In some of these embodiments, internal magnetic shield 205 may be sized and/or profiled to fit between contact plate 215 and shell dome 130 and to optimize its shielding properties.

In a few embodiments, one may add further layers of magnetic shielding to provide increased attenuation of residual magnetic field as desired. In a non-limiting example, one may attach a thin shielding material (e.g. paperShield) on outer surfaces of device. In another non-limiting example, one may cover thin shielding materials and/or other surfaces with Mylar or other suitable coating.

In some embodiments, extending piece 125 may be any suitable shape and/or size as desired by users. In a non-limiting example, an extending piece may have a button shape which may have a rotatable panel. In another non-limiting example, an extending piece may have a hook shape. In some of these embodiments, extending pieces may be attached to a panel by any suitable method and/or means, including, without limitation, screws, glue, rivet, weld, snap, etc. In other embodiments, extending piece may be molded to any shape. In some embodiments, extending pieces may be flexible wires which users may bend and/or unbend. Some of these embodiments may provide improved safety by bending to prevent objects and/or persons from getting caught on extending piece 125.

Figure 5:
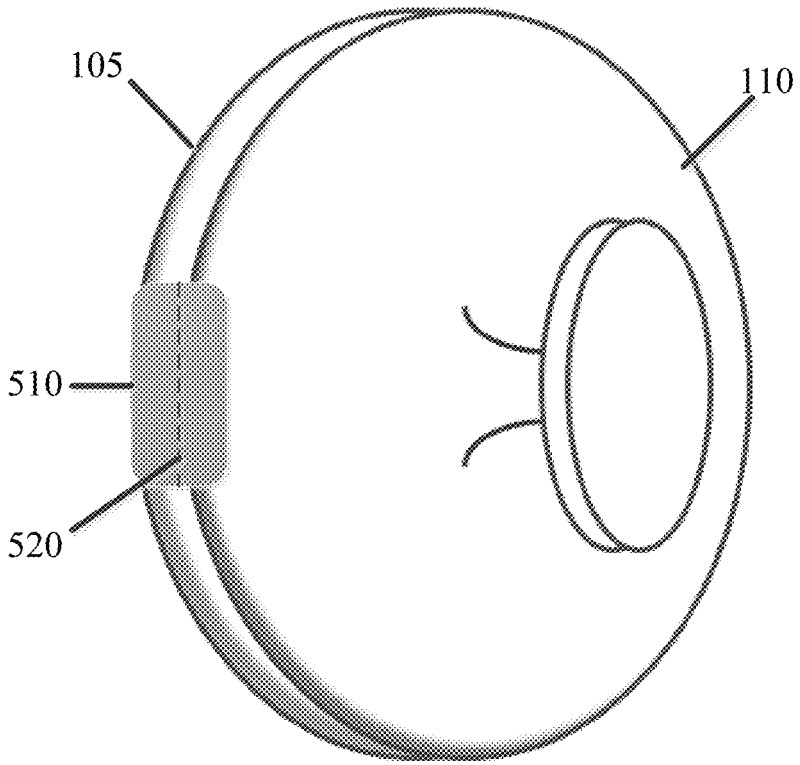
FIG. 5 is an illustration of an exemplary device, in accordance with an embodiment of the present invention.

FIG. 5 is an illustration of an exemplary device, in accordance with an embodiment of the present invention. In the present embodiment, the first part 105 and the second part 110 are shown in contact with each other for storage when not in use. At least one releasable device 510 keeps the first part 105 and the second part 110 together. In some other embodiments, device 510 may include a flexible hinge means 520 where the first part 105, the second part 110 and device 510 form a type of c-clamp.

Figure 6:
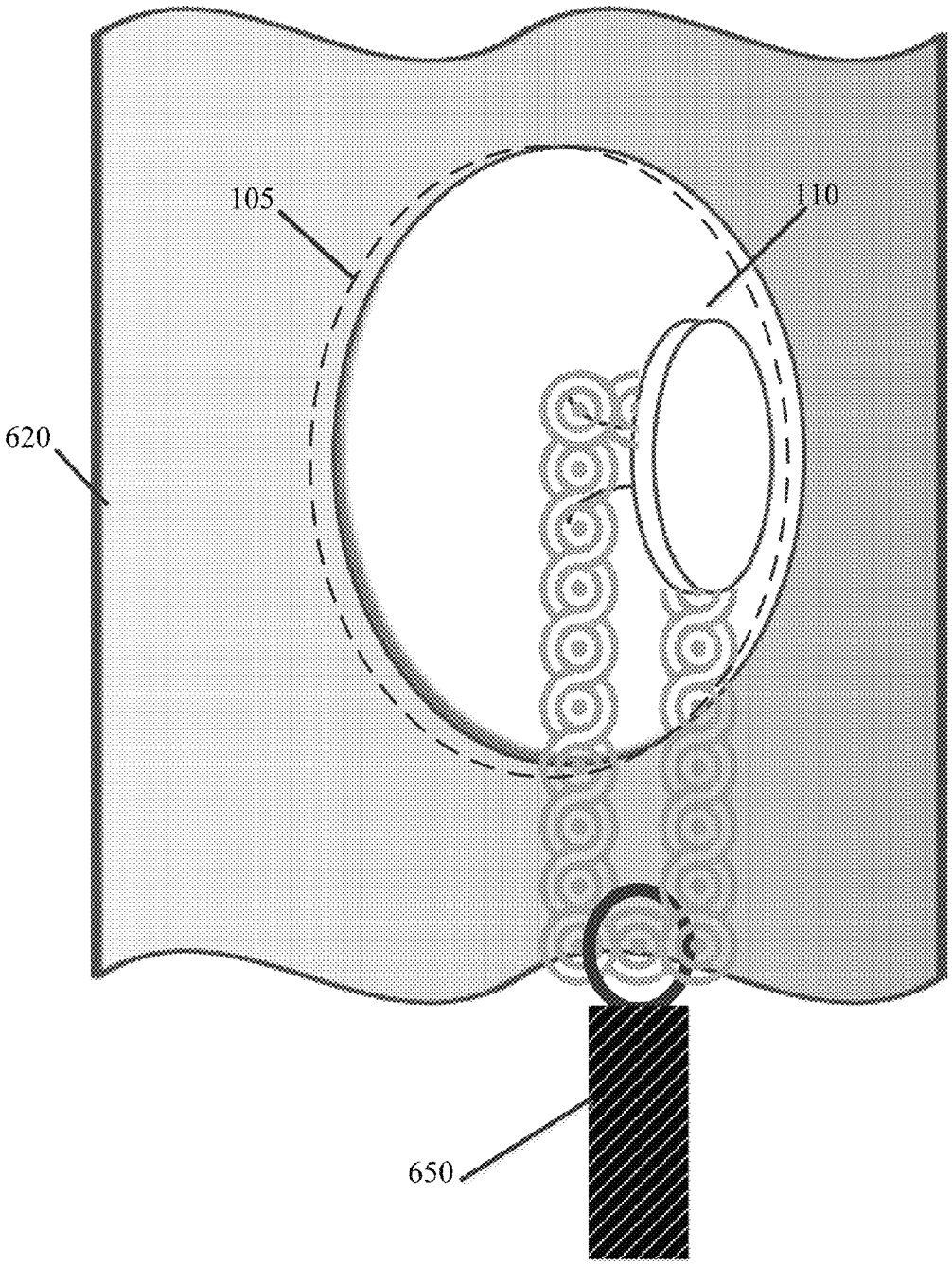
FIG. 6 is an illustration of an exemplary application for a device, in accordance with an embodiment of the present invention.

FIG. 6 is an illustration of an exemplary application for a device, in accordance with an embodiment of the present invention. In the present embodiment, the first part 105 and the second part 110 are clamped to partition 620 to hold item 650 at a position on the partition. Examples of the partition may include a sheet of material such as, without limitation, shower curtain, window curtain, drape, table cloth, glass panel, door screen, etc.

Those skilled in the art will readily recognize, in light of and in accordance with the teachings of the present invention, that any of the foregoing steps may be suitably replaced, reordered, removed and additional steps may be inserted depending upon the needs of the particular application. Moreover, the prescribed method steps of the foregoing embodiments may be implemented using any physical and/or hardware system that those skilled in the art will readily know is suitable in light of the foregoing teachings. For any method steps described in the present application that can be carried out on a computing machine, a typical computer system can, when appropriately configured or designed, serve as a computer system in which those aspects of the invention may be embodied. Thus, the present invention is not limited to any particular tangible means of implementation.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

It is noted that according to USA law 35 USC §112 (1), all claims must be supported by sufficient disclosure in the present patent specification, and any material known to those skilled in the art need not be explicitly disclosed. However, 35 USC §112 (6) requires that structures corresponding to functional limitations interpreted under 35 USC §112 (6) must be explicitly disclosed in the patent specification. Moreover, the USPTO's Examination policy of initially treating and searching prior art under the broadest interpretation of a "mean for" claim limitation implies that the broadest initial search on 112 (6) functional limitation would have to be conducted to support a legally valid Examination on that USPTO policy for broadest interpretation of "mean for" claims. Accordingly, the USPTO will have discovered a multiplicity of prior art documents including disclosure of specific structures and elements which are suitable to act as corresponding structures to satisfy all functional limitations in the below claims that are interpreted under 35 USC §112 (6) when such corresponding structures are not explicitly disclosed in the foregoing patent specification. Therefore, for any invention element(s)/structure(s) corresponding to functional claim limitation(s), in the below claims interpreted under 35 USC §112 (6), which is/are not explicitly disclosed in the foregoing patent specification, yet do exist in the patent and/or non-patent documents found during the course of USPTO searching, Applicant(s) incorporate all such functionally corresponding structures and related enabling material herein by reference for the purpose of providing explicit structures that implement the functional means claimed. Applicant(s) request(s) that fact finders during any claims construction proceedings and/or examination of patent allowability properly identify and incorporate only the portions of each of these documents discovered during the broadest interpretation search of 35 USC §112 (6) limitation, which exist in at least one of the patent and/or non-patent documents found during the course of normal USPTO searching and or supplied to the USPTO during prosecution. Applicant(s) also incorporate by reference the bibliographic citation information to identify all such documents comprising functionally corresponding structures and related enabling material as listed in any PTO Form-892 or likewise any information disclosure statements (IDS) entered into the present patent application by the USPTO or Applicant(s) or any 3$^{rd}$ parties. Applicant(s) also reserve its right to later amend the present application to explicitly include citations to such documents and/or explicitly include the functionally corresponding structures which were incorporate by reference above.

Thus, for any invention element(s)/structure(s) corresponding to functional claim limitation(s), in the below claims, that are interpreted under 35 USC §112 (6), which is/are not explicitly disclosed in the foregoing patent specification, Applicant(s) have explicitly prescribed which documents and material to include the otherwise missing disclosure, and have prescribed exactly which portions of such patent and/or non-patent documents should be incorporated by such reference for the purpose of satisfying the disclosure requirements of 35 USC §112 (6). Applicant(s) note that all the identified documents above which are incorporated by reference to satisfy 35 USC §112 (6) necessarily have a filing and/or publication date prior to that of the instant application, and thus are valid prior documents to incorporated by reference in the instant application.

Having fully described at least one embodiment of the present invention, other equivalent or alternative methods of implementing magnetic devices according to the present invention will be apparent to those skilled in the art. Various aspects of the invention have been described above by way of illustration, and the specific embodiments disclosed are not intended to limit the invention to the particular forms disclosed. The particular implementation of the magnetic devices may vary depending upon the particular context or application. By way of example, and not limitation, the magnetic devices described in the foregoing were principally directed to implementations having multiple parts; however, similar techniques may instead be applied to single-part devices which may attach to a suitable surface, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The Abstract is provided to comply with 37 C.F.R. Section 1.72 (b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. A device comprising:

a first button shaped part comprising:

a first contact portion, wherein said first contact portion is configured to make contact with a partition, in which said partition comprises at least one of a shower curtain, a window curtain, a glass panel and a door screen;

a first recess portion, wherein said first recess portion being disposed proximate a middle portion of said first contact portion;

a first magnetic core component, wherein said first magnetic core component being operable for generating a first magnetic flux, and wherein said first magnetic core component being disposed in said first recess portion, and wherein said first recess portion is configured to generally channel said first magnetic flux towards said partition, in which said first magnetic core comprises a plurality of magnetic elements in an array;

a protective layer, wherein said protective layer is configured to seal said first contact portion and said first magnetic core component, and configured to keep said first magnetic core component securely in place;

a first internal magnetic shield element, wherein said first internal magnetic shield element is configured to minimize said first magnetic flux generally transmitting through a first outer shell layer section; and in which said first outer shell layer section comprising at least a first shell dome segment and a first outer decorative magnetic shield layer being configured to further reduce said first magnetic flux;

and a second button shaped part, in which said second part comprising:

an extending piece, wherein said extending piece is configured to provide a means for hanging objects, in which said extending piece comprising at least a plastic-wrapped wire having a proximate end terminated by a protective safety cap;

a second contact portion, wherein said second contact portion is configured to make contact with said partition generally opposite said first contact portion, in which said second contact portion comprising a ferromagnetic contact plate operable for generating a second magnetic flux;

a second internal magnetic shield element, wherein said second internal magnetic shield being configured to reduce said second magnetic flux from transmitting through a second outer shell layer section; and in which said second outer shell layer comprising at least a second shell dome segment, wherein said extending piece being disposed on a proximate outer surface of said second outer shell dome segment, in which said second outer shell layer section further comprising at least a second decorative magnetic shield layer being configured to further reduce said second magnetic flux from transmitting through said second outer shell layer section.

2. The holding assembly as recited in claim 1, in which said plastic-wrapped wire is a bendable plastic-wrapped wire , wherein said plastic-wrapped wire is configured to bend into a desired shape operable for holding items.

3. The holding assembly as recited in claim 1, in which said first decorative magnetic shield being disposed proximate an outer surface of said first outer shell layer section to further shield said first and second magnetic flux from transmitting through said first outer shell layer section, thereby being operable to effect a reduction in an attraction of an unintended magnetic or metal object in a vicinity of said holding assembly.

4. The holding assembly as recited in claim 1, in which ferromagnetic contact plate comprises at least two or more of magnetic elements in an array, wherein said magnetic elements being arranged and configured to channel said second magnetic flux in a predetermined direction and minimize said magnetic flux in any other direction.

5. The holding assembly as recited in claim 1, wherein said second decorative magnetic shielding layer being disposed on said second magnetic shield, said second decorative layer being visible through said second outer shell layer section.

6. The holding assembly as recited in claim 4, wherein said protective layer comprising at least one of, a liquid vinyl applied as paint or spray and a liquid silicone rubber spray being disposed on said first contact side and said first magnetic core, wherein said first protective layer being operable for enhancing a frictional engagement of said partition.

7. The holding assembly as recited in claim 1, wherein said first protective layer comprises at least one of, a liquid vinyl applied as paint or spray and a liquid silicone rubber spray being disposed on said first contact portion and said magnetic core component.

8. The holding assembly as recited in claim7, in which said protective layer further comprises a cushioning material configured to provide substantial protection against corrosion for said first contact plate and said first magnetic core.

9. The holding assembly as recited in claim 1, in which said ferromagnetic contact plate comprises a plurality of magnetic elements in an array.

10. The holding assembly as recited in claim 1, in which said ferromagnetic contact plate comprises a plurality of magnetic elements in an array, wherein said magnetic elements being configured to channel said second magnetic flux toward said partition and substantially reduce said second magnetic flux from flowing in undesirable directions.

11. The holding assembly as recited in claim 4, in which said first button shaped part further comprising at least one of a proximate round shaped and a proximate oval shaped first part, and in which said second button shaped part further comprising at least one of a proximate round shaped and a proximate oval shaped second part corresponding to the shape of said first button shaped part, and in which said second button shaped part further comprises a magnetic core in the form of a Halbach array.

12. The holding assembly as recited in claim 1, in which said plurality of magnetic elements in an array comprises at least an array of magnets in the form of a Halbach array being configured to channel said first magnetic flux in a predetermined direction or substantially reduce the flow of said first magnetic flux in undesirable directions.

* * * * *